US005239227A

United States Patent [19]

Kikinis

[11] Patent Number: 5,239,227

[45] Date of Patent: Aug. 24, 1993

[54] HIGH EFFICIENCY PANEL DISPLAY

[76] Inventor: Dan Kikinis, 3235 Kifer Rd. Suite 110, Santa Clara, Calif. 95051

[21] Appl. No.: 826,368

[22] Filed: Jan. 27, 1992

[51] Int. Cl.[5] ..... H05B 33/02; H05B 33/10; H05B 33/26

[52] U.S. Cl. ..... 313/506; 313/495; 340/781; 315/169.3; 427/66

[58] Field of Search ..... 313/505, 506, 495; 340/781; 315/169.3; 427/66

[56] References Cited

U.S. PATENT DOCUMENTS 4,924,144 5/1990 Menn et al. ..... 313/506 X
5,004,956 4/1991 Kun et al. ..... 340/741

*Primary Examiner*—Sandra L. O'Shea
*Attorney, Agent, or Firm*—Donald R. Boys

[57] ABSTRACT

An electroluminescent display has a viewing surface with electroluminescent cells arranged in a dot matrix array over the surface, each cell having a height orthogonal to the surface from five to ten times any dimension parallel to the surface and each cell having electrodes on opposite sides to apply an electrical field across the cell parallel to the surface of the display. The dimension between the electrodes is no more than two microns, allowing the display to operate at low voltage levels. Thin film and thick film methods for constructing the display are disclosed.

8 Claims, 15 Drawing Sheets

HIGH EFFICIENCY PANEL DISPLAY

FIELD OF THE INVENTION

The present invention is in the area of panel displays for presenting alphanumeric and graphic information, and pertains in a preferred embodiment to flat panel displays comprising a matrix of light-emitting structures.

BACKGROUND OF THE INVENTION

There are many well-known uses for panel displays, among them television screens, including very small screens, such as for "wristwatch" TVs, and familiar computer screen applications. Computer systems require user input to initiate functions and to provide values for variables, among other reasons, and typically have displays, also called video display terminals (VDTs), for providing data and information to the user.

There are several different technologies used for displays, among them cathode ray tubes (CRTs), liquid crystal displays (LCDs), vacuum florescent displays (VFDs), gas discharge displays, electroluminescent displays (ELDs), light-emitting diode (LED), incandescent displays, and electromechanical displays. The most used display technology for computers is the well known CRT, which is used with almost all desktop VDTs. Other display types are used for various purposes. For example, LCDs are common in many digital wristwatches.

While CRTs are the most commonly used displays for VDTs, they are not well suited for portable computer displays such as laptop and notebook types. CRTs are too bulky and generally too fragile for use in small portable units that must withstand transport and occasional shock. CRTs are completely out of the question for small displays, such as "wristwatch" TVs, because of their size and complexity.

For flat panel displays for portable computer systems and other uses, liquid crystal technology is widely used, and some commercially available products use gas plasma displays, which are more expensive and require high voltage drives. Another type coming into wider use is electroluminescent displays (ELDs), which use areas or layers of material that emit light under the influence of an electrical field. The ELDs typically require high voltage as well, such as 150 to 200 volts.

There are problems and concerns common to all types of available flat panel displays, among them intensity of light output, power consumption, voltage required for operation, and resolution. Portable computers and portable TVs are intended for use outside the usual office or home environment, where there is little control of ambient light. It is desired that these be useful even in bright sunlight. Light output, (intensity), therefore, is a very big concern. A display that has poor light output cannot provide good visibility and contrast for images, especially under conditions where the ambient lighting is relatively strong.

Some displays, such as LCDs, are passive and have no inherent light generation ability at all. These rely on auxiliary light supplied, such as backlighting and by reflection.

It is generally true for light-emitting displays that more light can be delivered at the expense of power consumption, and power consumption for portable displays, such as for portable computers is a very serious concern. Every effort is normally made to minimize power consumption, to provide the maximum possible usable time between necessary battery charge or replacement. High power consumption also develops more heat, and dissipation of heat can be an additional problem.

Resolution becomes more and more of a concern as the overall size of a display becomes smaller. For example, one of the operating modes of the popular VGA video adapter for computer screens provides 640 pixels per line and 480 lines. A pixel, for this purpose, may be thought of as a "light dot". This is a total for the screen of 307,200 pixels. This is about 6 pixels per square mm for a screen of about 200 mm by 250 mm. The distance between pixels is about 300 microns in this arrangement. A micron is $10^{-6}$ meters.

A "wristwatch" TV may have a display as small as about ¾ inch (about 20 mm) square. This is about 400 square millimeters, and at 6 dots per square mm, a total of 2400 pixels to form the same images displayed on a VGA computer screen 100 times larger in area. The resulting images must be very rough, and alphanumerics would not be displayable.

What is needed is a display that significantly increases light output for power consumed, and does so with a lower voltage drive than the 150 to 200 volts required of some displays today. The need is to enhance visibility and contrast even with lower power use, and at the same time to provide a dot density sufficient for very small displays.

SUMMARY OF THE INVENTION

An electronic display is provided according to the present invention with a viewing surface having a plurality of electroluminescent cells arranged in a dot matrix array. An excitation system is connected to the cells for selectively exciting them electrically to provide images. Each cell in the array has an elongated structure of electroluminescent material wherein the length, orthogonal to the viewing surface, is at least five times the extent of any dimension parallel to the viewing surface.

Each cell also has a first electrode along one side for substantially the length, and a second electrode electrically isolated from and opposite the first, also along substantially the length. Each of the electrodes comprises an area of conductive material in contact with the electroluminescent material, which is substantially contained between the areas of the electrodes.

A preferable arrangement has the cells in a rectangular array of rows and columns, and the excitation system has row traces adjacent rows of cells with connections in each row between the row trace and the first electrode of each cell in the adjacent row of cells. There are also in this preferable arrangement column traces adjacent columns of cells, with connections in each column between the column trace and the second electrode of each cell in the adjacent column of cells.

The electroluminescent cell according to the present invention, by having a length several times longer than any dimension at right angles to the length, the length being at right angles to the viewing surface, is able to project light more efficiently toward a viewer of the display than is possible with displays of the prior art.

By forming electrodes for electrically exciting the cells across the smaller dimension rather than across the full length, the cell operates at a substantially lower voltage than is possible with displays of the prior art, as well. The result is that the display of the present invention provides substantially better intensity and contrast at less voltage and power than has heretofore been possible.

Also in the present invention unique methods are provided for constructing the display of the invention, both with thin film and with thick film techniques.

DESCRIPTION OF THE PREFERRED EMBODIMENTS

Figures 1A, 1B:
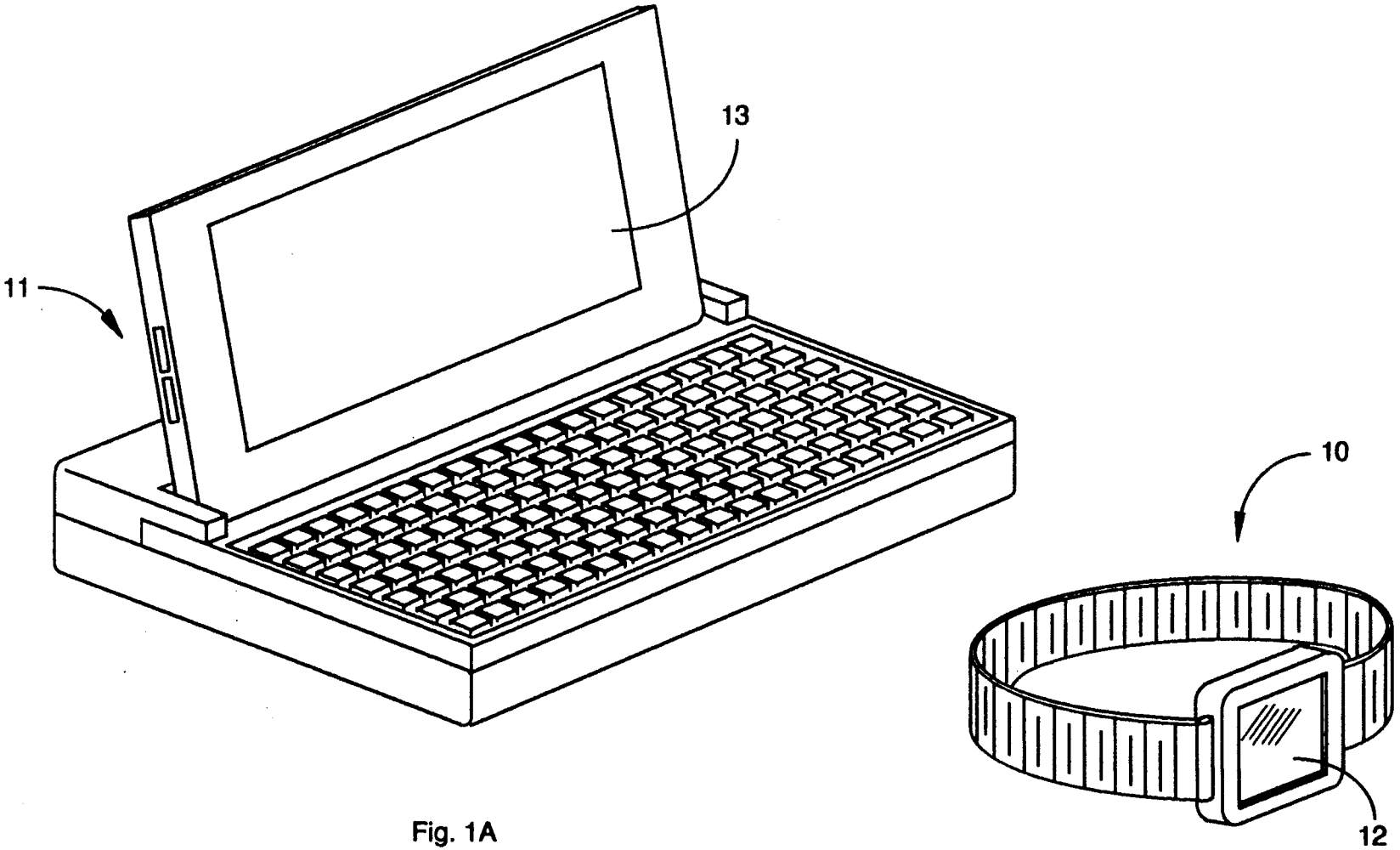
FIG. 1A is an isometric view of a portable computer having a display according to the present invention.
FIG. 1B is an isometric view of a "wristwatch" TV according to the present invention.

FIG. 1A is an isometric view of a notebook computer system 11 with a flat panel display 13 according to the present invention. The computer system is conventional, and could as well be a desktop system, a workstation, or some other type of computer system for which such a display would be useful.

FIG. 1B shows a "wristwatch" TV 10 with a display 12 according to the present invention. The area of display 12 is about 400 square mm.

FIGS. 1A and 1B are representative of applications for flat panel displays, and are preferred applications for the invention. It will be apparent to persons with skill in the art that there are many other applications for displays for which the present invention will be useful and advantageous, such as displays for instrument control systems and the like.

Displays 12 and 13, and other displays according to the present invention, are based on a substantially flat sheet with light-emitting cells constructed in a manner to produce more light with less power and voltage than conventional displays. The description below of display 13 of the notebook computer is meant to apply as well to "wristwatch" TV display 12 and other displays that may be applications for the display of the present invention.

The image mechanics of displays, such as the familiar CRT, are all similar in some degree, in that they are all based on images comprising arrangements of points of light, or dots, on the screen. In a CRT display, the points are illuminated by the action of an electron beam striking a screen having one or more layers of materials that emit light when struck by an electron beam, typicaly phosphor materials.

Often the smallest point (or dot) that a system is capable of displaying is smaller than the basic element that is actually displayed. One reason this is so is that it is often economic to limit the resolution of a display even though a higher resolution could be attained. Higher resolution generally requires more computer memory to store data for the display, more sophisticated software capability, and even higher processing speed.

The basic display element, often made up of several dots, is called a pixel in the art, which is a shortening of the term "picture element". In a CRT display, the dots are not an inherent function of the structure of the screen, but of the movement of an electrol beam and the timing of bursts of power to the beam. The beam is "swept" across the screen at different levels, defining lines, and activated a specific number of times for each sweep. For example, as already described above, one of the operating modes of the popular VGA video adapter provides 640 pixels per line and 480 lines. This is a total for the screen of 307,200 pixels. This is about 6 pixels per square mm for a screen of about 200 mm by 250 mm. and provides a spacing between pixels of about 300 microns.

The display in the present invention comprises a fixed array of light-emitting structures, so the dot density is a function of the physical implementation of the display. In some displays, such as CRT displays, the density is not a function of the physical design of the display.

Figure 2:
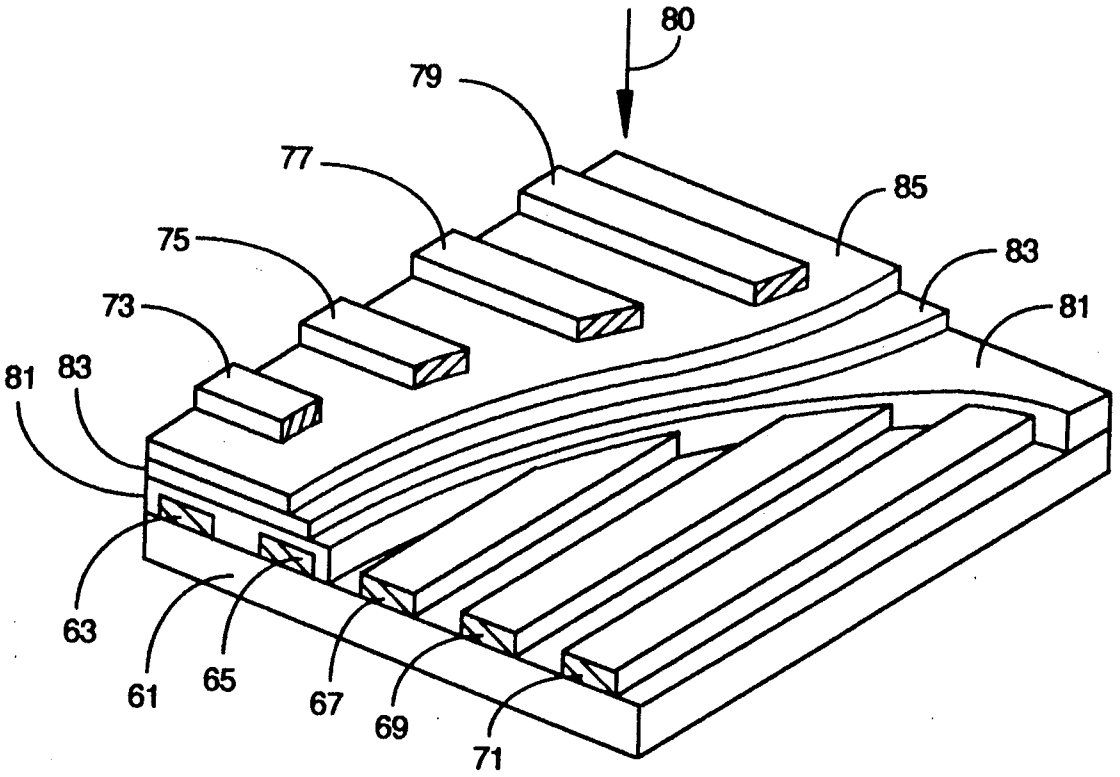
Fig. 2 (Prior Art)
FIG. 2 is an isometric view in partial section of an electroluminescent display according to the prior art.

FIG. 2 is an isometric view of a thin film electroluminescent display of the prior art, partially cut away to show the internal organization. The display of FIG. 2 is implemented on a glass plate 61, and consists essentially of two series of electrodes with an electroluminescent material between them. The viewing direction is the direction of arrow 80.

One series of parallel electrodes may be called row electrodes and the other series of parallel electrodes may be called column electrodes. It is arbitrary which is called which. Electrically conductive elements 63, 65, 67, 69, and 71 in this example are the column electrodes, and electrically conductive elements 73, 75, 77, and 79 are the row electrodes.

In general terms of construction, after the column electrodes are formed on glass plates 61, a layer of electrically insulative material 81 is deposited over them. One suitable insulator is silicon dioxide. There are other insulators that might be uses.

A layer of electroluminescent material 83, such as zinc sulfide doped with manganese, is then deposited over insulative layer 81. Later 83 provides the active material that emits light in response to an applied electrical field. Another layer 85 of insulative material is deposited over the light-emitting material of layer 83, and this layer must be transparent, because if it were not transparent, it would block light from the display. After insulative layer 85 is deposited, the row electrodes are formed on top of layer 85, substantially at right angles to the column electrodes. The row electrodes must also be transparent, because otherwise they would block light from the display.

The active areas in this display are the areas where a row electrode passes over a column electrode in a spaced-apart relationship. At each of these points one of each electrode comes into close proximity with the electroluminescent material in between. That is, at the intersection of a row and a column electrode, there is a local cell formed with electroluminescent material in between the two electrodes. The active area is the area of the intersection. If the two electrodes are connected to driver circuitry so that a voltage of about 150 to 200 volts (usually alternating current) is imposed between them, and across the depth of the electroluminescent material, the electroluminescent material emits light. Because of the geometry it is generally necessary that the row electrodes (73, 75, 77, and 79 in FIG. 2) and insulating layer 85 be transparent. One useful material for the row electrodes is Indium-Tin Oxide (ITO), because this material is transparent, electrically conductive, and may be readily deposited. The electrodes shown are merely representative of much larger arrays, which may comprise thousands of electrodes.

Driving circuitry for such electroluminescent displays of the prior art has been developed, and is similar in some respects to such circuitry used for other kinds of what are known in the art as dot matrix displays. In general, row and column electrodes are all switchable, with one connectable to a power source and the other usually connected to a common line to which the opposite pole of the power source is also connected. To activate a single dot in the display, both the row and column electrode must be "active", so a voltage is imposed across a small region of electroluminescent material. Drive circuitry is typically multiplexed (scanned) to activate the dots in the display.

Figure 3A:
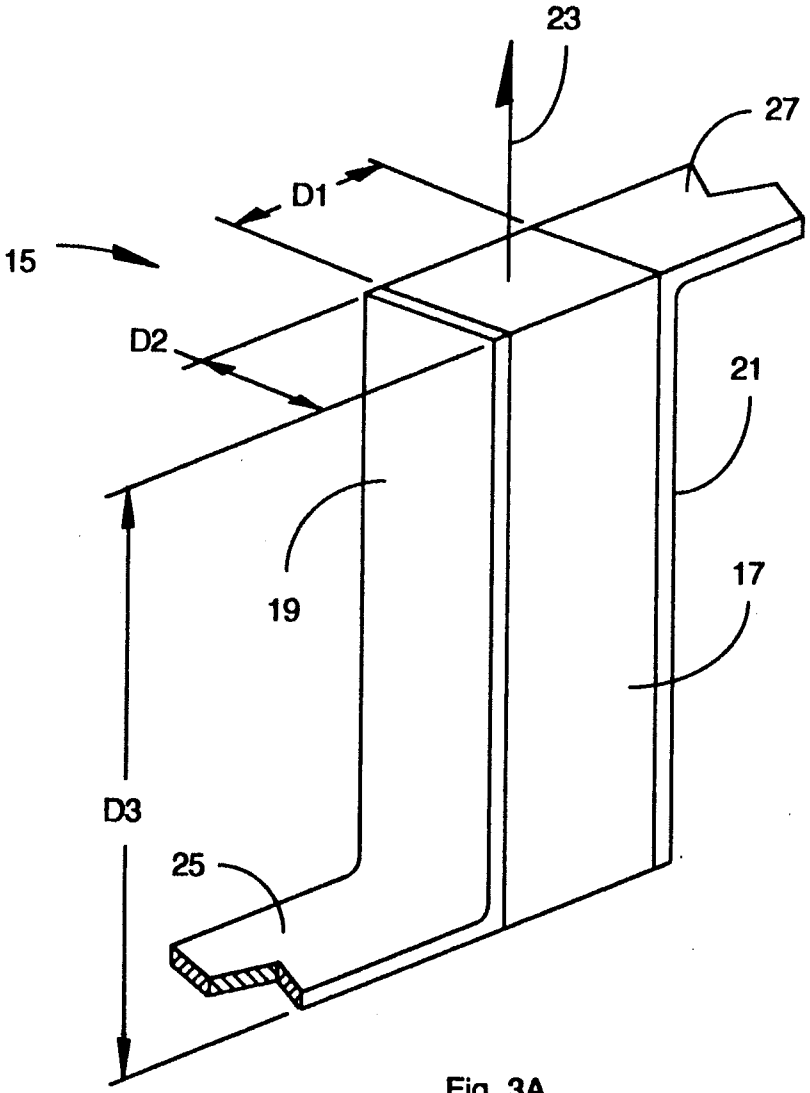
FIG. 3A is an isometric view of a single electroluminescent cell according to the present invention.

FIG. 3A is an idealized illustration of a single light-emitting cell 15 according to the present invention, providing a single controllable dot in an array. In the cell shown in FIG. 3A, an elongated structure 17 is formed of a material that produces light under the influence of an electrical field, such as zinc sulfide doped with a rare earth material. Dimensions D1 and D2 are preferably about equal in this embodiment, and vary from about 1 to about 2 microns, with the smaller dimension preferred. In the actual cell the cross-sectional shape will not necessarily be a perfect square as shown in the idealized structure. Dimension D3 is from 5 to 10 times dimension D1 or D2. For example, for a D1 and a D2 of 1 micron, D3 is preferably from 5 to 10 microns. For a D1 and a D2 of 2 microns, D3 will be preferably from 10 to 20 microns.

The reason for the high length to width ratio is to take advantage of the waveguide phenomena associated with elongated structures. Light produced within or guided into a structure of the sort shown in FIG. 3A, that is, having a length several times greater than dimensions at right angles to the length, will tend to be transmitted preferably along the length of the structure, partly because of reflection and diffraction characteristics of the closer sidewalls, and will be preferably emitted from the small ends, as shown by arrow 23. Light from the opposite small end is partly reflected and blocked from being emitted, as that end is against an opaque surface in a finished display. Arrow 23 is also in direction an orthogonal to the surface of the screen, opposite in direction to the viewing direction. The ratio of light energy emitted from the small end to light emitted from the sidewalls will be about the ratio of D3 to D1 or D2. In this case from about 5:1 to about 10:1. This is an application of the principles responsible for the success of fiber optic transmission.

Provision of discrete light-emitting structures, and elongation of the light-emitting structures, is partially responsible for greater efficiency for the present invention compared to conventional displays. Another feature that increases the efficiency of the cell of the invention is the geometry of the application of the electrical field. The display of the prior art, as shown in FIG. 2, applies the driving potential across the thickness of the electroluminescent layer, and the layer has to have a thickness sufficient to provide adequate material to emit a desired amount of light.

In the present invention, electrically conductive material is formed on two sides of the length of structure 17, providing electrodes 19 and 21, with electrical contact being made to conductive traces 25 and 27 respectively to supply electrical potential for the electrical field to excite light output from structure 17. In FIG. 3A, each electrode is shown as a contiguous part of a conductive trace, although this need not be so, as long as electrical contact is made.

The advantage of applying the electrical field across the short dimension of elongated structure 17 is that the light produced is proportional not to the voltage, but to the field strength, which is measured in volts/unit length. In devices of the prior art, as already pointed out, voltage applied must be as high as 200 volts. The structure shown as prior art in FIG. 2, and the 200 volt requirement, are both taken from *Microprocessor Based Design*, by Michael Slater, pp 367, Copyright 1989 by Prentice-Hall, Inc., a division of Simon and Schuster.

In the present invention, an electrical field strength equivalent to that of the prior art can be achieved with only about 20 to 40 volts, because of the relatively short dimension between electrodes. The much lower voltage, coupled with the effect of elongated structures to direct more light in the needed direction, that is, substantially orthogonal to the plane surface of the display screen, provides up to ten times the light with one tenth the voltage, an advantage in light intensity vs voltage of about 100:1, compared to the prior art.

The lower voltage necessary to drive the display of the present invention also provides a display compatible with low-power CMOS technology, and cuts heat generation as well.

Figure 3B:
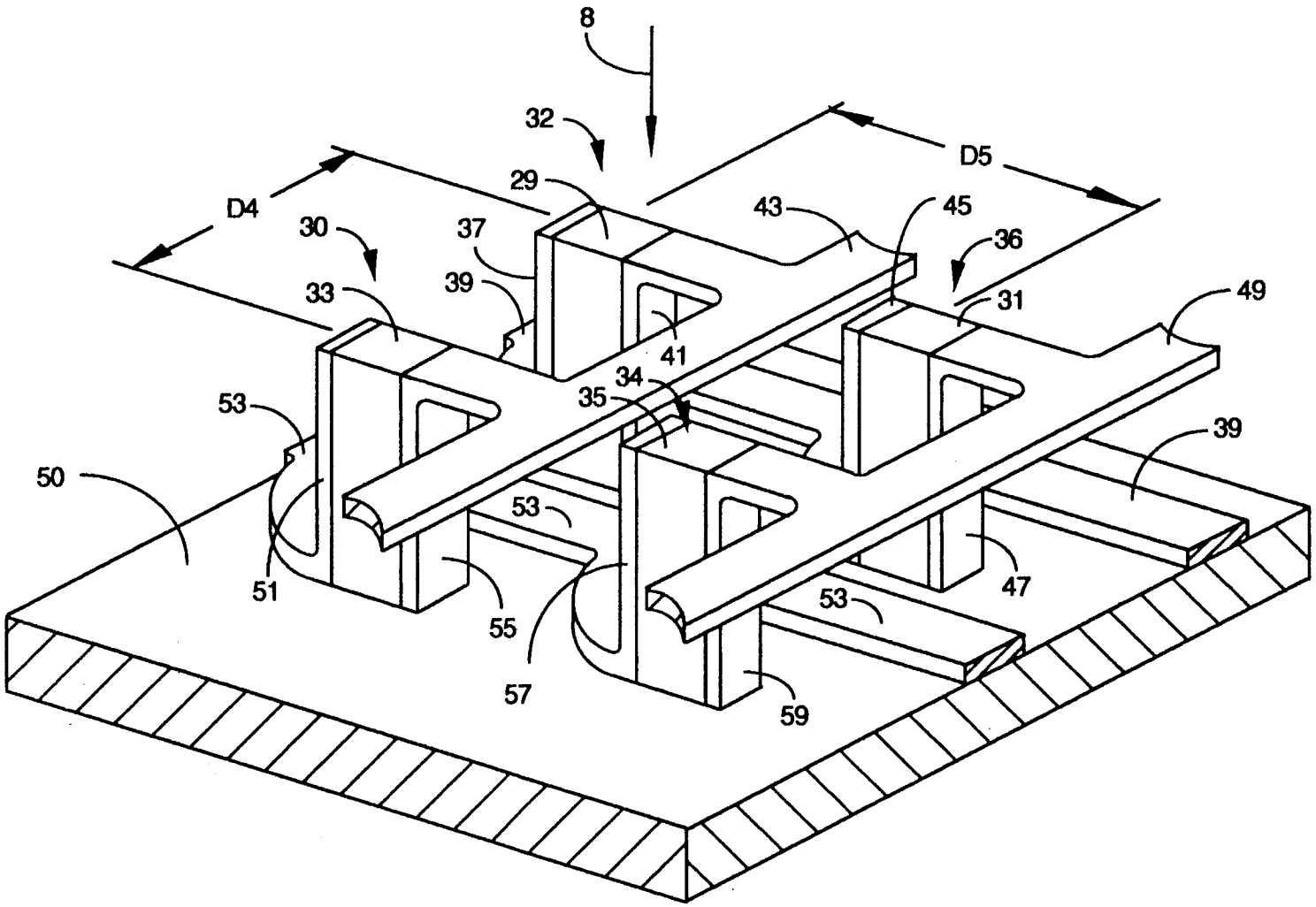
FIG. 3B is an isometric view of a grouping of four electroluminescent cells according to the present invention connected to conductive traces.
Figure 3C:
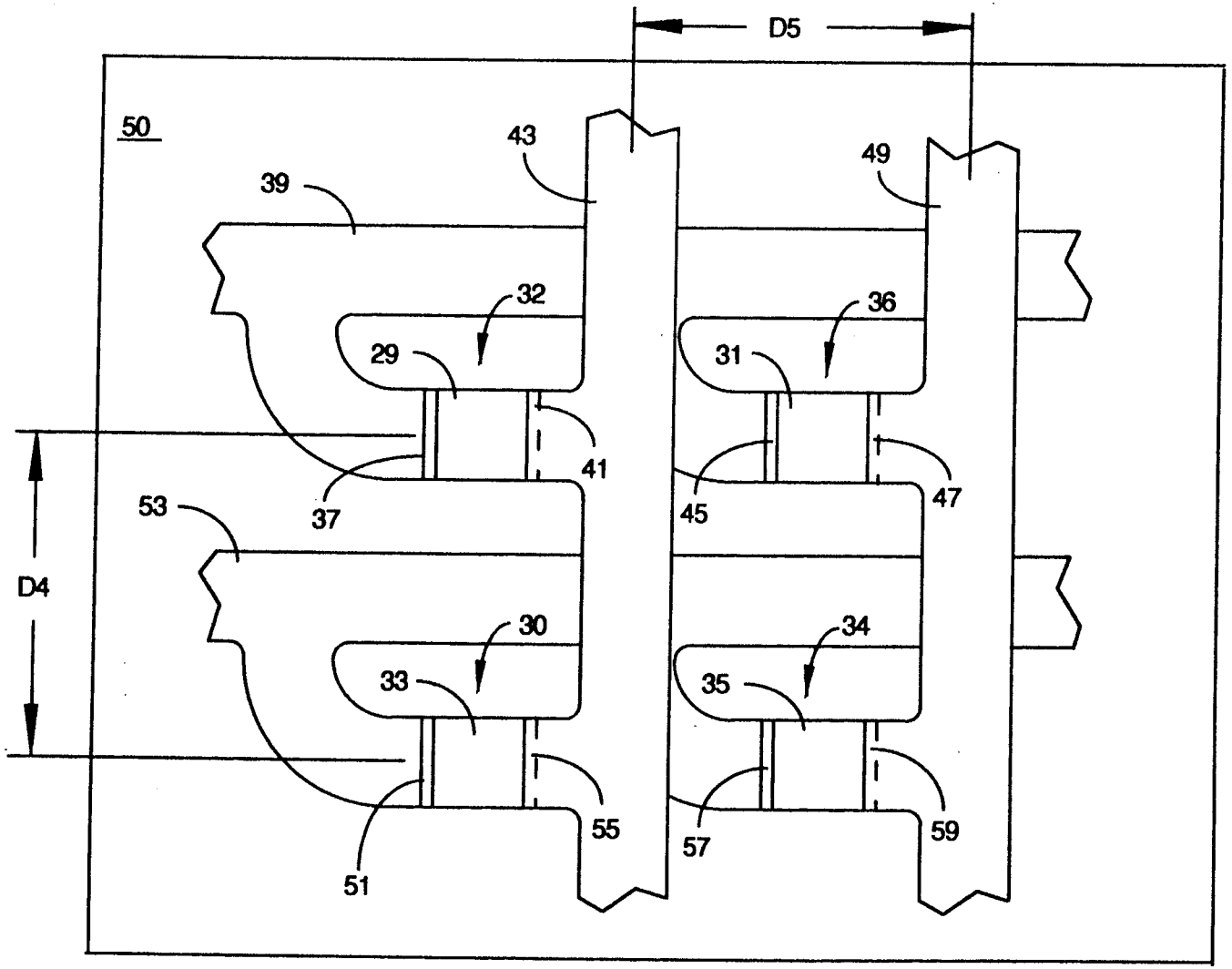
FIG. 3C is a plan view of the grouping of cells shown in FIG. 3B.

FIG. 3B is an isometric view showing four light-emitting cells 30, 32, 34, and 36, comprising idealized light-emitting structures 29, 31, 33, and 35, along with electrodes, according to the present invention, in a square array. The viewing direction is the direction of arrow 8. FIG. 3C shows the same four cells in plan view. The four cells shown are representative of a much larger cartesian array of cells in the embodiment described. Each of the four light-emitting cells shown in FIG. 3B and FIG. 3C comprises two electrodes, one on each of opposite vertical walls.

In FIGS. 3B and 3C cell 32 with structure 29 has an electrode 37 connected to conductive trace 39, and an electrode 41 connected to conductive trace 43. Cell 36 with structure 31 has an electrode 45 connected to trace 39 and an electrode 47 connected to conductive trace 49. Cell 30 with structure 33 has an electrode 51 connected to conductive trace 53, and an electrode 55 connected to conductive trace 43. Cell 34 with structure 35 has an electrode 57 connected to conductive trace 53, and an electrode 59 connected to conductive trace 49. Although only four idealized cells are shown in FIG. 3B, they are sufficient to illustrate the square array structure and connection scheme.

As mentioned above, the four cells shown are merely illustrative of a much larger array, comprising thousands of cells. Connection of electrodes for cells is in rows and columns. For example, trace 53, which may be considered a row trace, connects all electrodes on one side of a row of cells. Cells 30 and 34 with electrodes 51 and 57 respectively, represent a row of cells connected to one side by trace 53. Similarly, trace 39, parallel to trace 53, and at the same "level" in the three-dimensional structure, connects to electrodes 37 and 45 on cells 32 and 36.

Electrodes on the other side of each cell connect to column traces generally at right angles to the row traces. For example, electrodes 59 and 47, serving cells 34 and 36 respectively, connect to trace 49, a column trace, and cells 34 and 36 represent a column of cells. Similarly, electrodes 55 and 41, serving cells 30 and 32 connect to column trace 43, so cells 30 and 32 represent a column of cells parallel to the column formed by cells 34 and 36.

Each row trace is connected to one terminal of a power source through a switching circuit, so each row can be individually activated. Similarly, each column trace is connected to the opposite terminal of the same power source through a switching circuit, so each column trace may be individually activated. Thus, to activate a cell imposing the voltage of the power source across the cell, causing it to emit light, one row and one column trace must be switched "on".

Referring still to FIG. 3B, to switch "on" cell 30, it is necessary to activate both trace 43 and trace 53. This applies a voltage across structure 33 between electrodes 51 and 55. Although activating traces 43 and 53 also connects electrode 41 of cell 32 to the side of the power source connected to trace 43, and electrode 57 of cell 34 to the same side of the power source connected to trace 53, cell 30 is the only cell to have both electrodes connected across the power source, hence is the only cell in the array to be switched "on" to emit light.

In FIG. 3B the elements are shown as free-standing structures upon a plate 50, which may be one of a number of materials. Glass is a suitable material, and other materials, such as quartz and monocrystalline silicon may also be used. The volume surrounding the various elements shown is, in the actual implementation, an insulative deposited material, such as silicon dioxide. This material is not shown in FIGS. 3B and 3C so the structural details may be better seen and understood. Also in FIG. 3B, the row traces and the column traces are shown at widely separated levels in the overall structure. Column traces 43 and 49 are shown at the "upper" level, that is, at or near the surface on the viewing side of the display, while row traces 39 and 53 are shown "buried" at the surface of plate 50. This is a result of the idealized illustration, and is not necessarily required for the invention. Relative to position in the structure, it is required for the invention that the traces not suffer electrical short to one another. Keeping them separated at different levels in the structure helps to accomplish this purpose.

In the electroluminescent display of the prior art described with the aid of FIG. 2, electrodes 73-79 are necessarily transparent. If they were not, the light emitted could not be seen, because one of the electrodes crosses every "dot" in the display. In the display according to the present invention, the upper traces on the viewing side of the display need not be transparent, because they do not overlie the light-emitting structure. The upper electrodes in the invention can therefore be implemented in a broader choice of materials. Aluminum, for example, which is commonly used for such conductive traces in the manufacture of integrated circuits.

In the array shown in FIGS. 3B and 3C dimensions D4 and D5 are about equal (square array), and may be as small as about 10 microns. It is not strictly required that the array be square, nor even that the light-emitting "dots" be arranged in a square or rectangular matrix.

Such a matrix, however, is preferred, as it is a convenience in manufacturing and operation.

The "dot density" with a 10 micron square array is $10^4$ dots per square millimeter. This compares with the pixel density of a common VGA video mode of about 6 dots per square millimeter. Clearly the dot density of the display according to the present invention is capable of providing resolution beyond that of any other available technology. This extremely high physical resolution makes the display of the present invention suitable for high resolution, small displays, like "wristwatch" televisions, for example. In the "wristwatch" TV of FIG. 1B, having a screen area of about 400 mm as described above, the potential density of $10^4$ dots per square mm will result in 4 million light-emitting dots for the small TV screen. In the example above of a popular VGA mode for a computer display, there were about 300,000 pixels in the display, so the display of the present invention could have more than 12 times the resolution of the VGA display. It is not required that the light-emitting structures in the present invention be as close as 10 microns, and the actual matrix spacing is a function of the application for the display, and in some cases of the manufacturing technique used.

It is seen that in the array of the present embodiment, each light-emitting structure in a horizontal row is connected to a common conductive trace, and each light-emitting structure in a vertical column of the array is connected to a common conductive trace. There are existing drive technologies for driving matrix displays of this sort, and these are commonly used for such as LCD matrix displays, plasma dot matrix displays, and dot matrix electroluminescent displays as described above with the aid of FIG. 2. The display of the present invention may be driven with a wiring matrix of this conventional sort, but generally at a lower voltage.

There are a number of techniques usable in the manufacture of the display according to the present invention. For very high dot density, such as for a dot array spaced on about 10 micron centers, tested and proven techniques used in the manufacture of integrated circuits are preferred, together with unique arrangements developed for specific purposes for the invention. These IC manufacturing techniques are generally termed thin film techniques. In some other embodiments, there are unique techniques developed for manufacturing, which are described below, and generally termed thick film techniques.

Figure 4A:
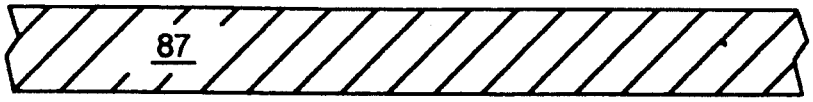
FIG. 4A is an elevation section view of a base plate for a display according to the present invention.

FIG. 4A shows a section of a substrate 87 upon which a display according to the present invention is to be fabricated. This substrate is the equivalent of plate 50 in FIGS. 3B and 3C, and may be a glass plate or a slice of monocrystalline silicon of the sort upon which integrated circuits are made. There are other suitable materials as well.

Figure 4B:
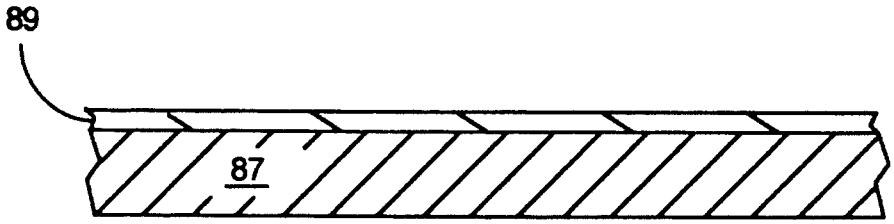
FIG. 4B is a section showing a polysilicon layer applied to the base of FIG. 4A.
Figure 4C:
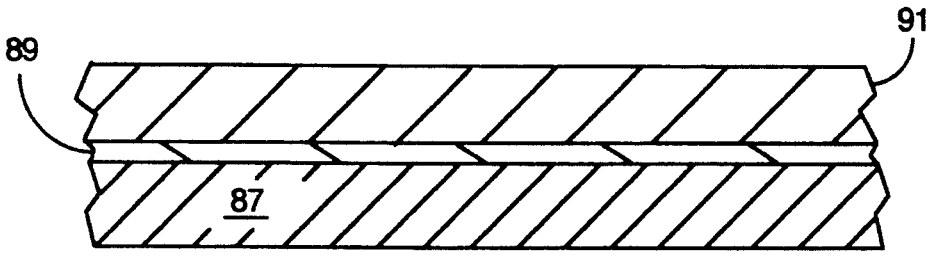
FIG. 4C is a section showing another step in construction with a layer of electroluminescent material deposited over the layer of polysilicon material shown in FIG. 4B.

FIG. 4B shows the substrate after deposition of a layer 89 of polysilicon, which acts as an intermediary and adhesion layer for a next layer of electroluminescent material to be deposited FIG. 4C shows a cross section of the developing display after deposition of a layer 91 of an electroluminescent material to a thickness of about 10 microns in this particular embodiment. The relative thicknesses of the substrate, the polysilicon material and the layer of electroluminescent material are not to scale. Substrate 87 is of a sufficient thickness to provide structural rigidity, such as about 1 cm., so the substrate is about $10^3$ times the thickness of the electroluminescent layer 91 in this embodiment. Physical sputtering is a technique that may be used for the deposition of the electroluminescent material, using a composite sputtering target. There are other deposition techniques as well.

Figure 4D:
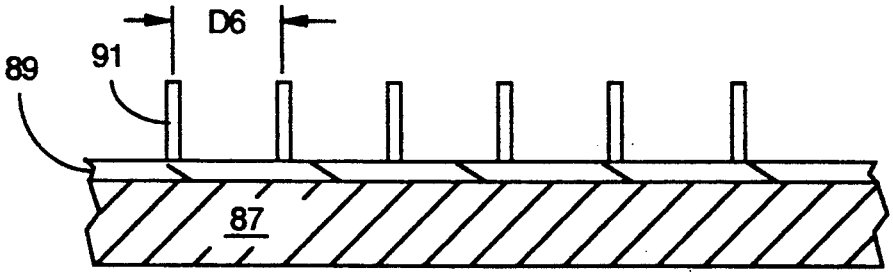
FIG. 4D is a section showing the result of etching the electroluminescent material of FIG. 4C to provide vertically oriented structures.

After deposition of electroluminescent layer 91, the surface is patterned and etched by conventional techniques producing an array of vertically oriented structures of electroluminescent material, preferably having a height to width ratio of from 5:1 to 10:1. FIG. 4D is a section through the array and shows a single row of structures of layer 91. The array is on centers preferably of about 10 microns, so dimension D6 is about 10 microns. Dry etching is a preferred technique because dry etching works well for etching relatively deep patterns.

Figure 4E:
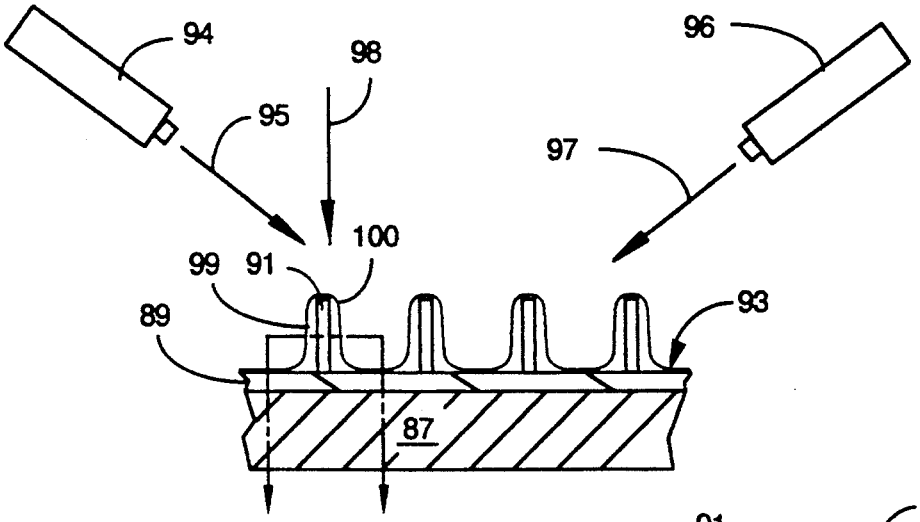
FIG. 4E shows an arrangement of deposition sources to preferentially deposit electrically conductive material on the structures shown in FIG. 4D.

FIG. 4E shows the result of a subsequent step in the fabrication wherein a layer 93 of electrically conductive material is deposited over the vertically oriented structures of electroluminescent material of layer 91. In this step a unique variation in a known technique is practiced to control the thickness of the conductive material of layer 93 deposited in preferred areas. The technique used is molecular beam deposition.

Molecular beam source 94 emits metal vapor in a highly directional manner substantially in the direction of arrow 95. A preferable material is aluminum, commonly used for electrical interconnection in IC fabrication. Source 94 represents a plurality of such sources arranged generally in a group such that the additive area of metal flux will encompass all of the area of the developing display. The sources 94 are all aimed at substantially the same angle, although the angle may change somewhat.

A similar group of highly directional sources represented by source 96 are aimed from the opposite side to deposit in the general direction of arrow 97 on the other side of each of the structures in layer 91. The result of the deposition is that the electroluminescent structures of layer 91 are coated with conductive material of layer 93 preferentially on two opposite sides.

Figure 4F:
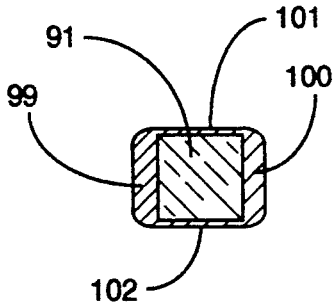
FIG. 4F is a section of one structure after deposition of electrically conductive material illustrating the result of preferential deposition.

FIG. 4F is a magnified section view of one of the structures of layer 91 taken at line 4F—4F of FIG. 4E. This section shows approximately the relative thicknesses of the metal coating on the four sides of each idealized structure after the directed deposition of layer 93. Areas 99 and 100, shown in both FIGS. 4E and 4F are areas of preferential deposition. Areas 101 and 102 are the sides at ninety degrees to the preferentially coated sides, and are areas of minimum deposition, being generally parallel to the line of arrival of coating material. The coating on areas 99 and 100 is several times thicker than the coating on areas 101 and 102.

Conductive material is also coated on the "floor" of the developing structure, that is, upon layer 89 between the vertically oriented structures of layer 91, but the thickness of conductive material in these areas will be relatively thin compared to the preferential deposition shown for areas 99 and 100 in FIGS. 4E and 4F. So after deposition of layer 93 of conductive material, there is an uneven, but unbroken, coating of conductive material over the entire surface of the developing display.

After coating with the electrically conducting material to make layer 93, the partially completed display is etched to leave electrically conductive material from layer 93 only in the areas 99 and 100, which are then the two electrodes associated with each electroluminescent structure, to provide a light-emitting cell. Part of this etching process is a dry plasma process, which removes material from layer 93 at an approximately even rate, except the upper tips of the vertical structures etch somewhat faster because of a tendency for the electrical potential over the display surface to be higher at these points.

After a selected period of etching at a known rate, electrically conductive material is removed completely from the areas of relatively lesser original thickness, such as areas 101 and 102 in FIG. 4F and the areas on layer 89, and from the tips of the vertical structures, and electrically conductive material remains, at a somewhat lesser thickness than originally deposited, only on two sides of each of the vertical electroluminescent structures. These newly isolated areas of electrically conductive material become the electrodes described with the aid of FIGS. 3B and 3C. For example, electrodes 37 and 41 on electroluminescent structure 29.

Figure 4G:
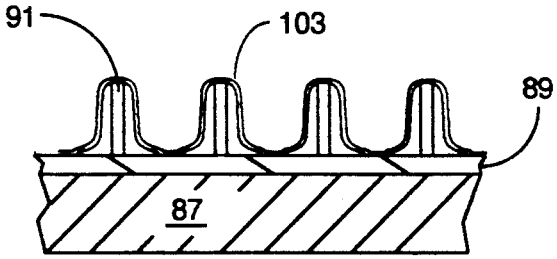
FIG. 4G is a section showing the result of depositing a thin film of insulative material over the structures shown in FIG. 4E after separating areas of conductive material.

In a next step a relatively thin electrically insulative layer 103 is deposited. FIG. 4G shows a cross section view after the etching process described above to provide the electrodes on each of the electroluminescent structures, and after deposition of insulative material to provide layer 103 to a thickness of a few hundred angstroms.

Figure 4H:
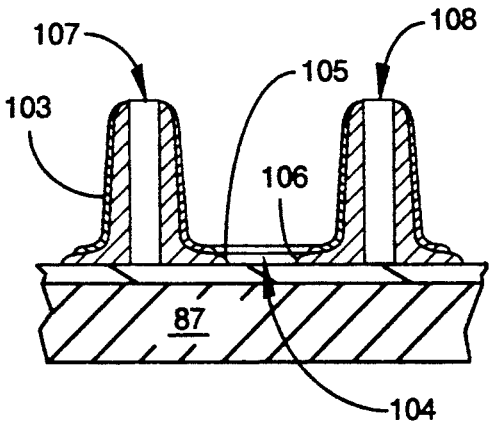
FIG. 4H shows the structures of FIG. 4G in section after etching a window for making electrical connection.

After the deposition of insulative material 103 shown in FIG. 4G, "windows" for electrical connection are opened between cell structures. FIG. 4H is a section view showing one window 104 between two adjacent cell structures 107 and 108. This is a process of masking, lithography, and etching as is well known in the art, and results in lower ends, such as ends 105 and 106, of electrodes on adjacent cell structures being exposed in each window.

Figure 4I:
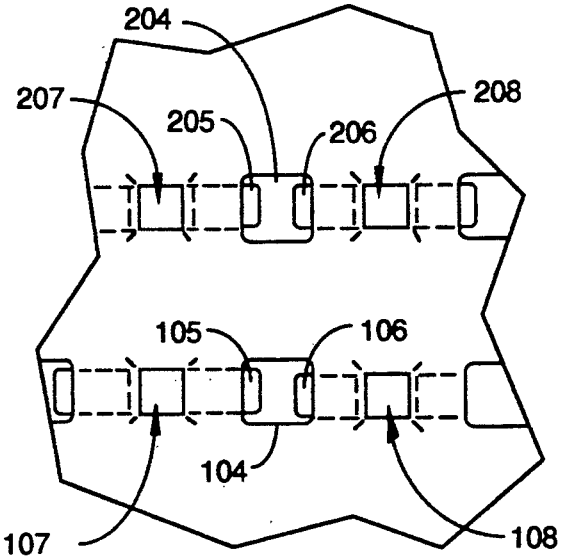
FIG. 4I is a plan view of the structure shown in FIG. 4H and another adjacent structure, to better illustrate the construction.

FIG. 4I is a plan view showing four cell structures 107, 108, 207, and 208, and two "windows" 104 and 204 opened between the cell structures. The electrodes proceeding from cells 107 and 108 are shown in dotted outline, ending in window 104 with exposed ends 105 and 106. Similarly, the electrodes proceeding from cells 207 and 208 are shown in dotted outline, ending in window 204 with exposed ends 205 and 206.

The windows are about two microns square, easily attainable in etching processes in the art. What remains from this point to complete the display is connection of electrodes for rows and columns of cells in the manner described above with reference to FIGS. 3A and 3B, so that for each cell there is a connection from one electrode to a row trace, and from the other electrode to a column trace. This part of the process is conventional, and accomplished by successive deposition and etching of preferably aluminum as is known and commonly practiced in the art of integrated circuit fabrication.

After connection of electrodes to row and column traces, the display is complete. In some embodiments a further deposition may be done to overlay the display with a transparent protective material. In other embodiments the display is assembled with a flat glass or transparent plastic panel over the top surface, to protect the display cells and connections.

Thin film equipment is commercially available to process substrates of about 25 cm. in diameter, which allows for displays for many applications. Equipment for larger areas can be built. The present invention is not limited in area by equipment capacity, however, because there are alternative ways the display may be fabricated. The display may be implemented on a glass panel, for example, and can be done by additive thick-film techniques as well as by the subtractive thin-film techniques described above.

Figure 5A:
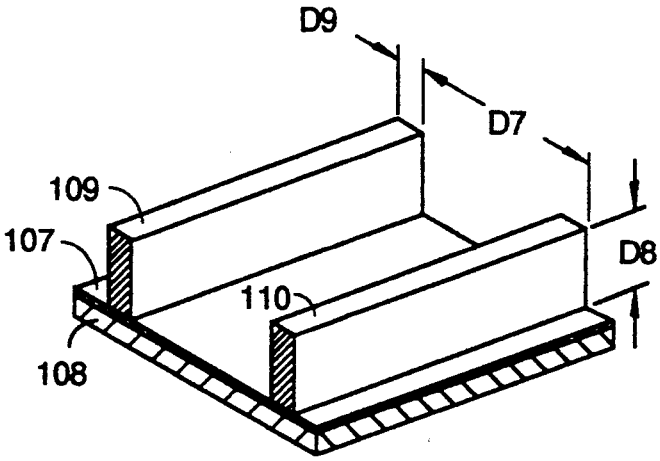
FIG. 5A is an isometric view showing early steps in a thick film construction technique according to the present invention.

In a thick film process, early steps of which are shown in isometric view in FIG. 5A, a first layer of polysilicon 107 is preferably applied to a glass plate 108, as is done for the thin film process described above, to serve as an adhesion and intermediary layer. Then row traces of conductive material are formed over the polysilicon layer to connect to electroluminescent structures to be subsequently deposited. Two traces 109 and 110 are shown. In the actual display there are thousands of such traces.

There are a number of alternative ways the conductive row traces such as traces 109 and 110 may be formed. Silkscreening, using a conductive paint-type material, usually copper or aluminum filled, is one way. Another alternative is deposition of a layer of conductive material, such as by sputtering, then using conventional lithography and etching techniques to remove part of the film to leave the traces, after which the thickness may be increased by electroplating. There are still other ways known in the art. The distance D7 between row traces is preferably about 30 to 50 microns in this process, to allow working room for following process steps. The depth D8 is preferably about 10 microns, and the width D9 may vary widely, from a few microns to as much as 20 or thirty microns. Dimension D9 depends to a large extent on the nature of the process step used to form the traces.

Figure 5B:
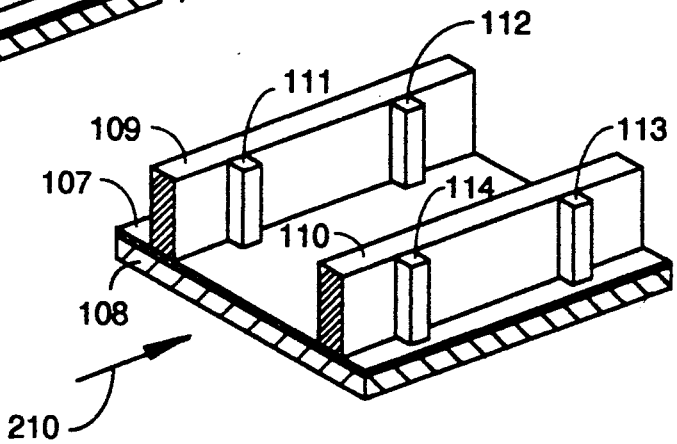
FIG. 5B shows a further step in the thick film technique, with vertically oriented electroluminescent structures deposited adjacent to electrically conductive traces.

FIG. 5B shows four structures 111, 112, 113, and 114 of electroluminescent material, such as zinc sulfide doped with manganese, deposited in contact with traces 109 and 110 by a unique plasma spay process.

Figure 5C:
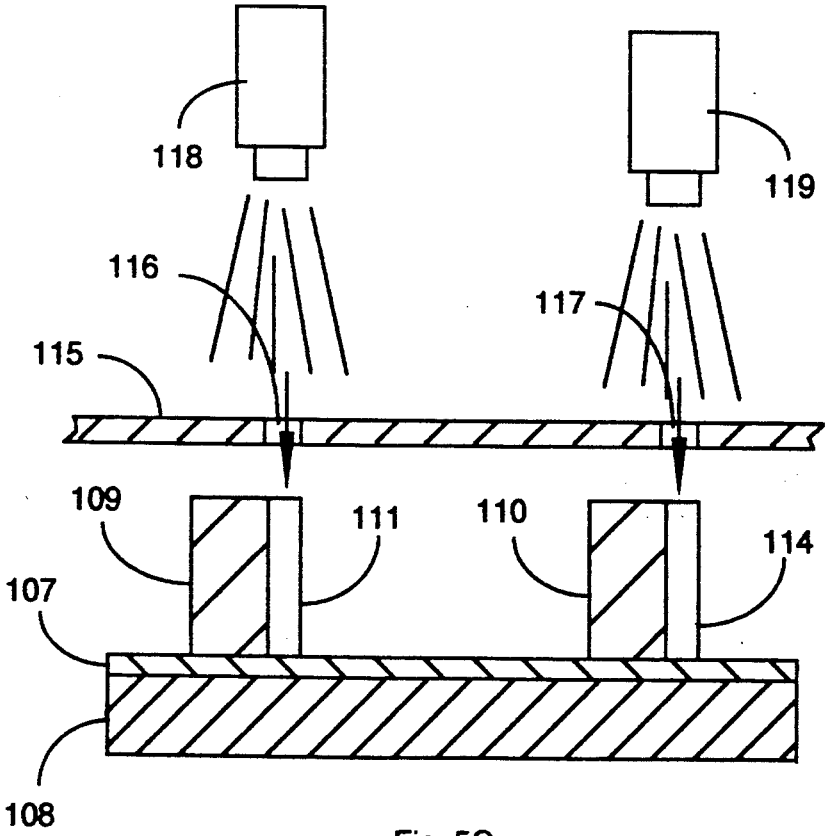
FIG. 5C illustrates a unique deposition technique for constructing the electroluminescent structures of FIG. 5B.

FIG. 5C is an elevation view of FIG. 5B in the direction of arrow 210 showing how the electroluminescent structures are deposited. A deposition mask 115 with openings such as openings 116 and 117 on center dimensions desired for the center distance between electroluminescent structures is positioned over the arrangement of FIG. 5A. To deposit the electroluminescent structures, an array of plasma spray devices (represented by devices 118 and 119) is positioned over mask 115, and vapor is directed in vacuum toward the mask. The deposition devices are positioned to provide a relatively even material flux, and in some cases, relative movement between the spray devices 118 and 119 and the mask is used to provide even material flux. In the case of such relative movement, there must be no movement between the mask and the surface upon which deposition is directed.

Material is intercepted by the mask except at the openings, where material passes through and solidifies forming the structures, such as structures 111 and 114, adjacent to the traces first formed on the display surface. Electroluminescent structures 111 and 114, as well as others formed through openings in mask 115, are substantially rectangular in cross section orthogonal to the length, and the dimensions of the cross section do not exceed two microns. The length of the electroluminescent structures, substantially the same as the height of row traces 109 and 110, is about ten microns. so the ratio of the length to any dimension at right angles to the length is from 5:1 to 10:1.

The size and spacing of the plasma spray devices is not represented to scale relative to the elements of the forming display in FIG. 5C, because the disparity in size is too great to show all details in one view to scale.

After deposition of the electroluminescent structures, resulting in the stage of completion shown by FIG. 5B, the mask is plasma etched to remove the intercepted material in readiness for the next deposition. Masking and deposition is performed in vacuum, and may be done in a single station machine or a system having multiple stations and transport devices. A multiple station machine may also be served by one or more load-locks to facilitate loading and unloading.

The fact of the original conductive traces such as trace 109 and 110 being about the depth of the electroluminescent structures such as structures 111, 112, 113, and 114, and the electroluminescent structures being deposited adjacent to (and in contact with) the traces, allows the traces to act also as electrode areas described in the thin film process detailed above.

Figure 5D:
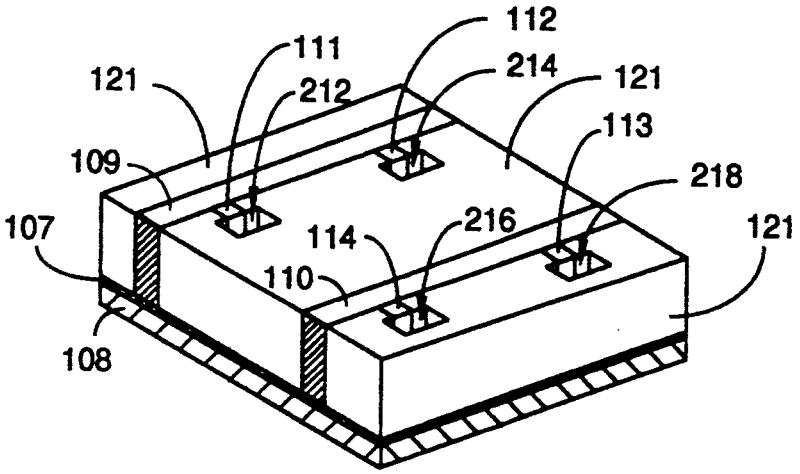
FIG. 5D is an isometric view showing the structures of FIG. 5C with photoresist deposited and holes opened to form second electrodes.

After deposition of electroluminescent structures 111, 112, 113, and 114, the display is covered with photoresist material and exposed through a lithography mask (not shown) that shadows areas immediately adjacent to the electroluminescent structures on the side opposite to the original conductive traces. After the curing of photoresist through a mask, the uncured material is removed by solvent. FIG. 5D is a view similar to FIG. 5B showing also photoresist layer 121, and four openings 212, 214, 216 and 218 which are opened adjacent to electroluminescent structures 111, 112, 113, and 114 by washing with solvent after the photoresist material is dured.

After forming openings 212, 214, 216 and 218 the final requirement to form a usable display according to the present invention is to fill openings 212, 214, 216, and 218 with conductive material to form the second electrode for each of the cells, and to connect these second electrodes to conductive column traces to complete the selective circuitry of the display.

Figure 5E:
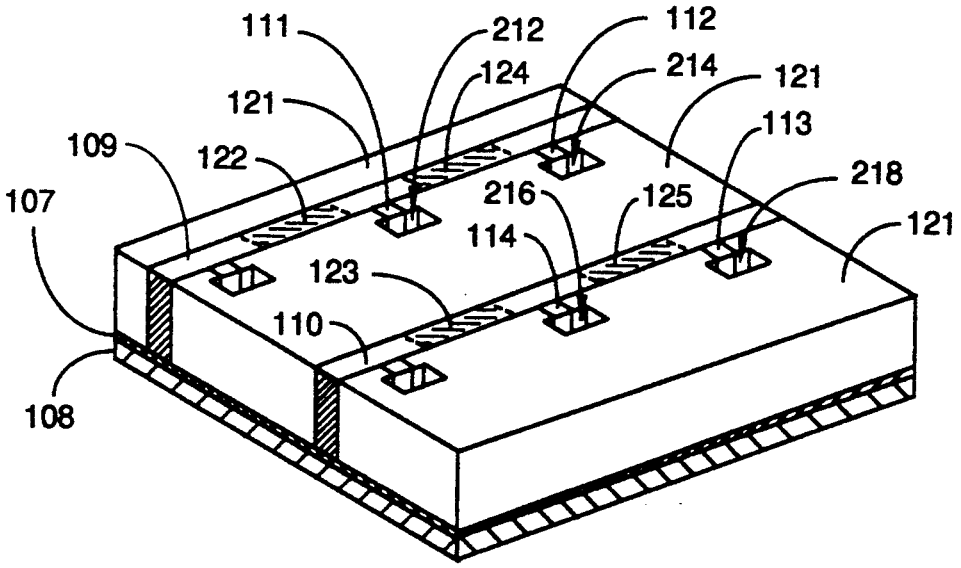
FIG. 5E is an isometric view illustrating critical areas to be protected before constructing column traces crossing row traces.

The row and column schematic of the traces is conveniently accomplished by having the column traces at generally right angles to the row traces. To do this, it is necessary that the traces do not make electrical contact where they cross. FIG. 5E is a somewhat expanded view similar to FIG. 5D showing critical areas 122, 123, 124, and 125, where conductive traces 109 and 110 need to be protected by an insulative cover to avoid shorting to column traces to be applied.

There are several alternative ways the separation of the traces to avoid shorting may be accomplished. One is to cover the traces in the step described above to apply photoresist layer 121, and to cure the photoresist through a mask that allows later removal of photoresist not only at the openings such as opening 212, 214, 216, and 218, but also over each of the electroluminescent structures, so light from an activated structure will not be blocked by photoresist. This leaves areas 122, 123, 124, and 125 covered with photoresist which will insulate between traces 109 and 110, and subsequent crossing traces. This a preferable method because it avoids additional deposition and etching steps.

Another way to insulate for the crossing traces is to deposit insulative material over areas 122, 123, 124, and 125 in a subsequent step.

Figure 5F:
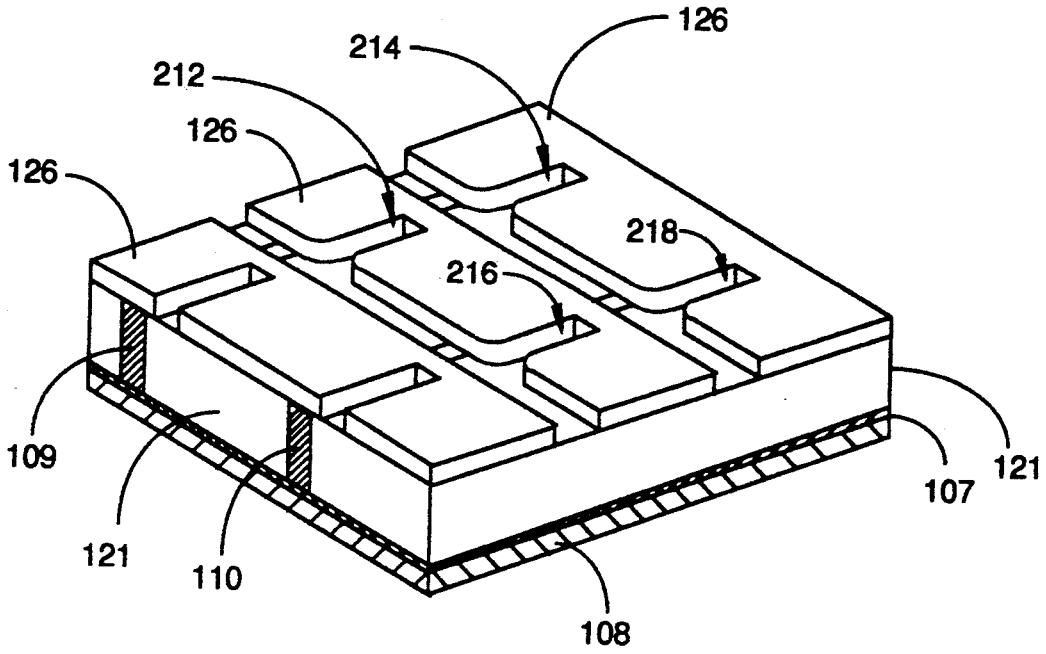
FIG. 5F shows a silkscreen mask positioned to construct electrodes and column traces for the display.

FIG. 5F is an isometric view of a portion of a silk screen mask 126 registered to and applied over the developing display to apply the final electrodes by filling openings 212, 214, 216, and 218 (FIG. 5D), and to apply the column traces in the same step. Openings 212, 214, 216, and 218 are below mask 126 in this view.

Figure 5G:
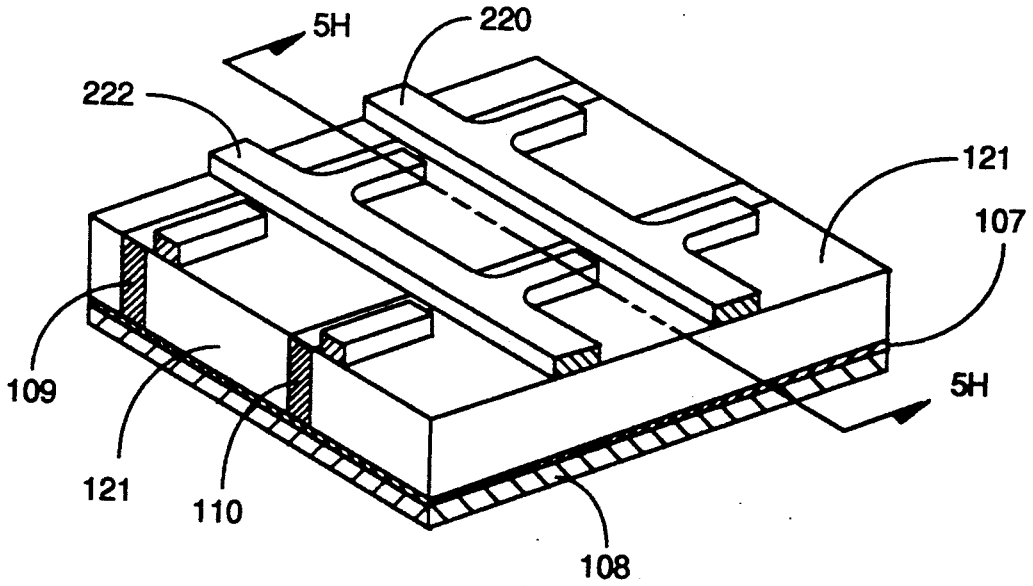
FIG. 5G shows the result of applying column traces with the silkscreen mask of FIG. 5F.

FIG. 5G is a view similar to FIG. 5F, except a paste-type silkscreen material filled with conductive material has been applied over the mask and cured, and mask 126 has been removed. The conductive silkscreen material has been urged into openings 212, 214, 216, and 218 to form electrodes against electroluminescent structures 111, 112, 113, and 114 (FIG. 5B), and leaves conductive traces 220 and 222 connected to the newly formed electrodes.

Figure 5H:
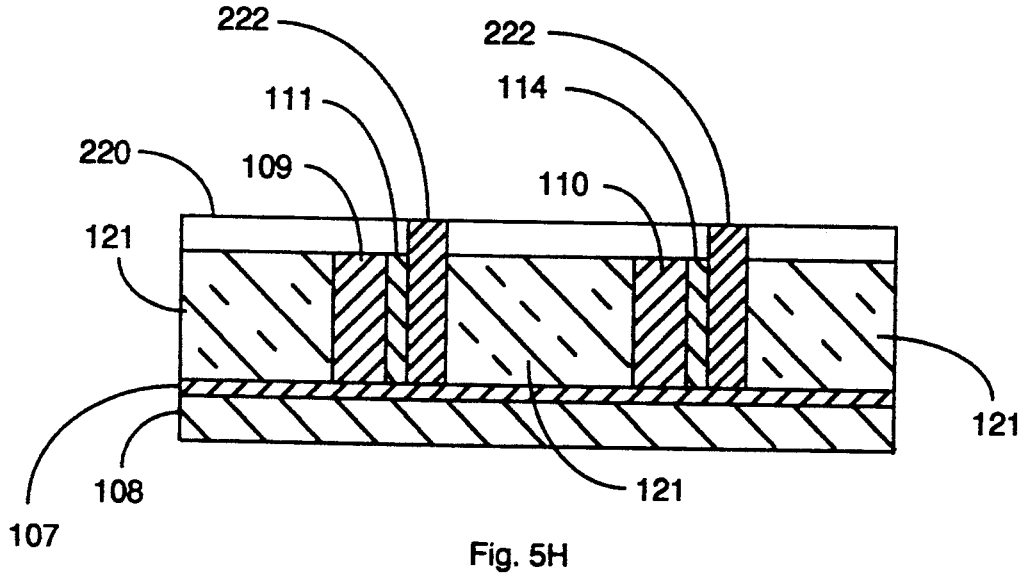
FIG. 5H is a section view taken on section line 5H—5H of FIG. 5G.

FIG. 5H is a section view taken along section line 5H—5H of FIG. 5G. Electroluminescent structure 111 now has conductive material from trace 109 on one side and conductive material from trace 222 on the other. These two regions of conductive material are the electrodes for the electroluminescent cell based on structure 111. Similarly, structure 114 now has trace 110 on one side and trace 222 on the other, and these are the electrodes for the cell based on structure 114. Similarly, all the cells in the display now have electrodes on each of two opposite sides, and the electrodes are a part of row and column traces.

A top layer of transparent material may be applied for protection of the traces and other elements, or the display may be assembled to a flat glass or plastic panel, as described above for displays formed by thin film manufacturing techniques. Connecting the row and column traces to drive circuitry renders the finished display usable for displaying images by illuminating individual electroluminescent structures.

In the thick film process for manufacturing a display according to the invention illustrated by FIGS. 5A through 5H and described in considerable detail above, there are a number of alternative ways to accomplish the structures. One deviation in the process described that is desirable in an alternative embodiment is to provide both electrodes for the electroluminescent structures in conjunction with the early step of forming row traces over the initial layer of polysilicon material. To do so requires forming islands of conductive material spaced apart from and alongside the row traces of conductive material.

Figure 5I:
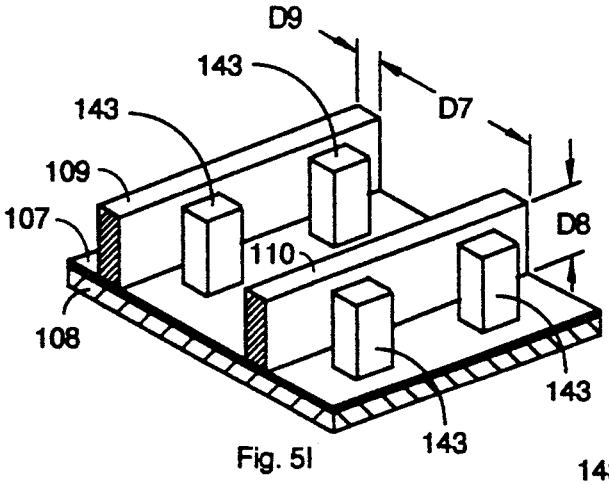
FIG. 5I illustrates islands of conductive material formed alongside traces of conductive material to serve as electrodes.

FIG. 5I shows the result of forming islands 143 as the row traces are formed. Four islands are shown. Just as the row traces perform as the first electrodes for cells, islands 143 subsequently perform as the second electrodes. There are many thousands of such islands in addition to the four exemplary elements shown.

Figure 5J:
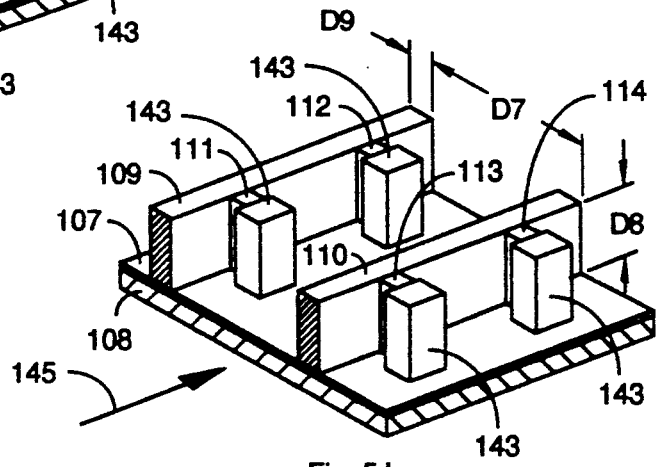
FIG. 5J shows the structures of FIG. 5I with structures of electroluminescent material formed between the islands and traces of conductive material.

FIG. 5J shows the result of deposition of electroluminescent material to form light-emitting structures 111, 112, 113, and 114, which are, in this embodiment, "sandwiched" between the row traces and the island structures 143.

Figure 5K:
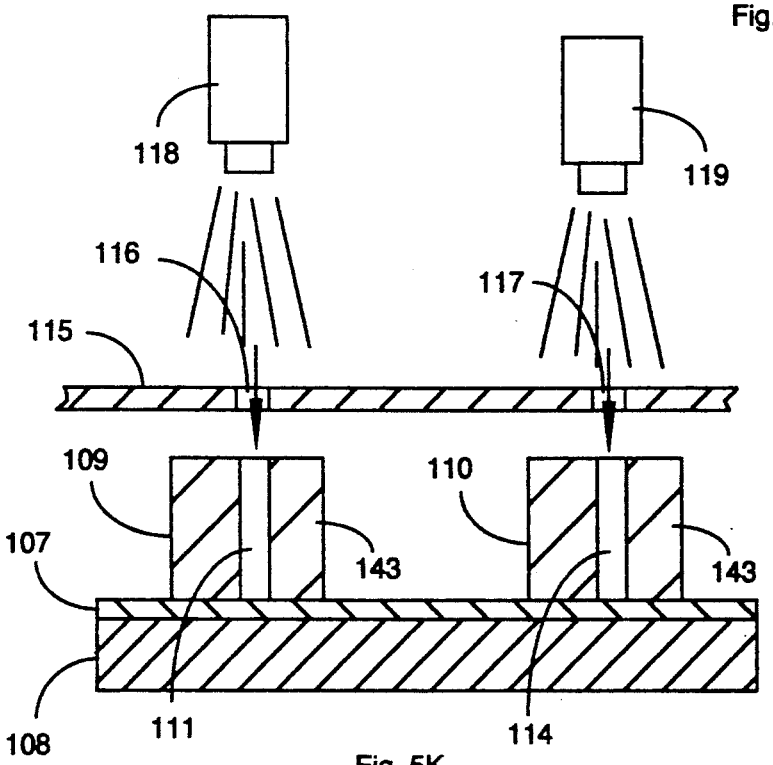
FIG. 5K shows electroluminescent material being deposited through a mask onto the structure of FIG. 5I.

FIG. 5K, similar to FIG. 5C, shows the unique plasma spray deposition method in operation, taken in the direction of arrow 145 of FIG. 5J. Electroluminescent structures such as structure 111 and 114 are formed between each island structure and the adjacent row trace. The island structure and the row trace in contact with an electroluminescent structure are then the two electrodes for applying an electrical potential across the short dimension of the electroluminescent structure.

A further advantage of the process in the embodiment presently described, with both electrodes formed in an early step before plasma spraying the electroluminescent structures, is that it is now not necessary to form holes for the second electrodes by photoresist and lithographic technique, as was described above with the aid of FIG. 5D. A layer of non conductive material is still useful to protect the conductive elements from shorting to one another, and to provide for insulation where column traces to be applied will cross row traces, as was described above with the aid of FIG. 5E.

Figure 5L:
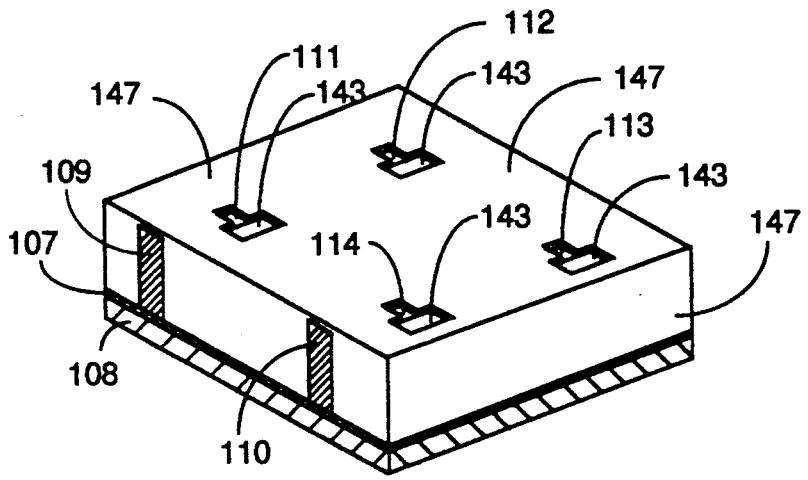
FIG. 5L shows the structure of FIG. 5J with photoresist applied over the structure and cured, leaving areas over the island structures and electroluminescent material open.

FIG. 5L, similar to FIG. 5D, shows the display in the state of completion shown by FIG. 5J, with electrically insulative layer 147 added. In FIG. 5K insulative layer 147 is still photoresist, and has been applied to a depth sufficient to cover all of the structure applied thus far, then cured through a mask leaving the area above islands 143 and structures 111, 112, 113, and 114 uncured. By washing away these uncured areas with a solvent, islands 143 and the upper ends of structures 111, 112, 113, and 114 are exposed again.

To complete the display in this alternative embodiment, the steps are the same as previously described above for the first-described thick film process, involving applying a silk screen mask, and forming column traces generally at right angles to the row traces, with each column trace connecting all of the conductive island structures 143 immediately adjacent to each column trace. This is the same step as described above for forming the column traces, except now it is not necessary to force the conductive silk screen material into deep holes to form the second electrodes for the electroluminescent cells.

Figure 5M:
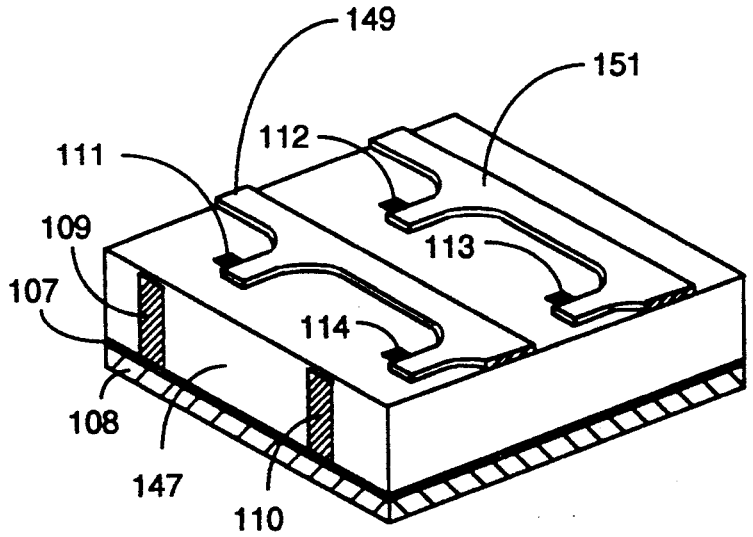
FIG. 5M shows the structure of FIG. 5L with connective traces added to connect to the island structure electrodes.

FIG. 5M shows the elements in the state of construction shown by FIG. 5L with column traces 149 and 151 added. Silkscreening is a preferred method, but not required. The column traces also might be done by blanket deposition and substractive technique (etching) as is known in the art of IC manufacture, or by other known methods of connective technology.

An alternative way that relatively large extent displays may be provided by the present invention is by arranging several smaller displays side-by-side to provide a display of a larger area, wherein the smaller displays are connected to be individually driven, or connected so that rows of adjacent smaller displays are commonly connected, and columns of adjacent displays are also commonly connected, so that the larger display may be driven by a single set of driver circuitry.

Figure 6:
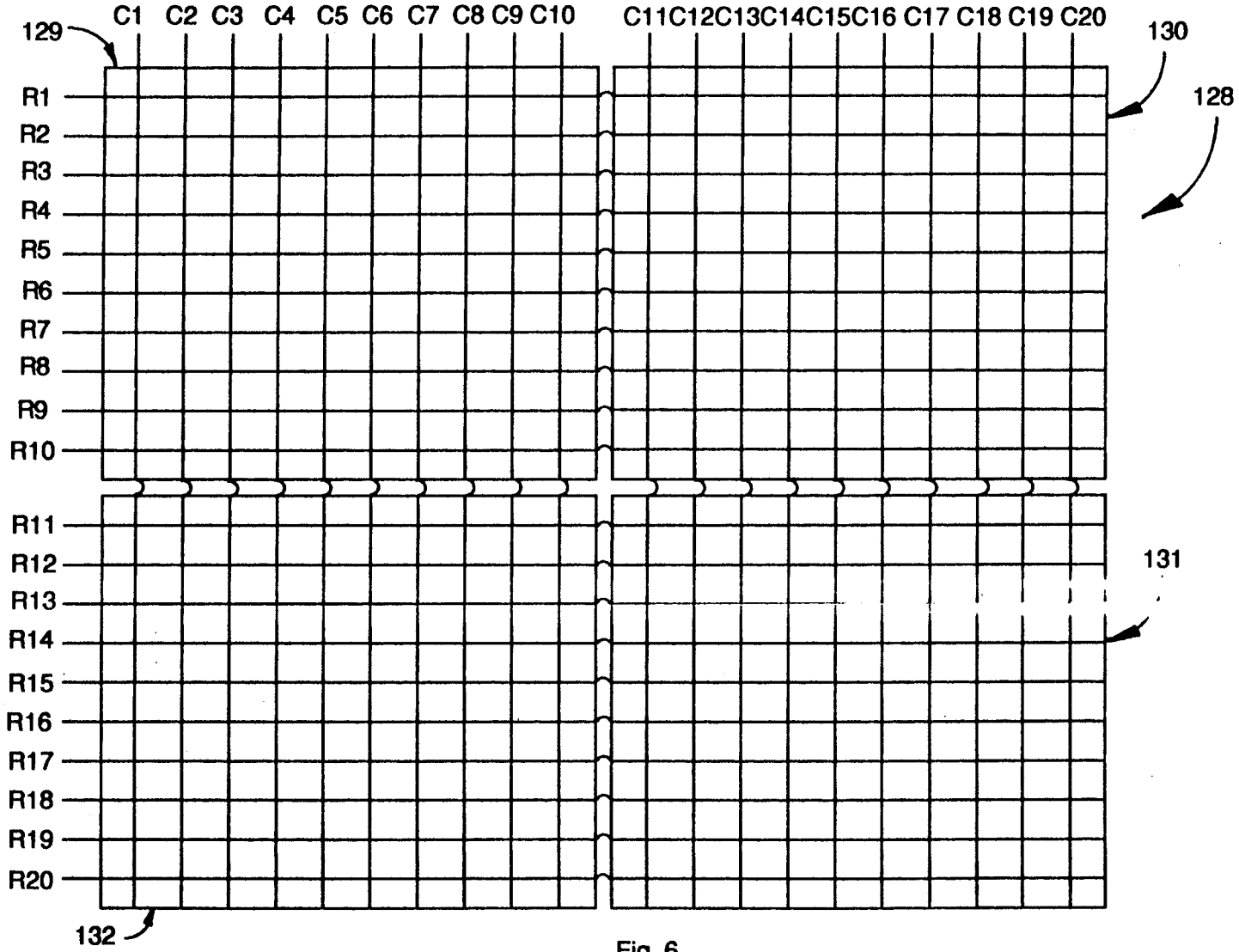
FIG. 6 is a plan view showing a connective scheme for driving a composite display made up of several displays according to the present invention.

FIG. 6 shows an exemplary composite display 128 according to the present invention having four smaller rectangular display panels 129, 130, 131, and 132, each of which has 10 rows and 10 columns. The row traces of panels 129 and 130 and of panels 132 and 131 are connected together, and the column traces of panels 129 and 132 and of panels 130 and 131 are connected together, so the assembly of four panels may be controlled as though it were a single panel with twenty row traces R1–R20 and 20 column traces, C1–C20. In a like manner composite displays of greater extent may be constructed and operated as a single panel. Alternatively, separate panels may be separately driven, with each panel displaying a part of an overall image. It will be apparent to one with skill in the art that a limitation on the size of a single panel will not be a necessary limitation on the overall size of a display that may be constructed.

The color of a display according to the present invention is a function of the electroluminescent material that is used for the light-emitting structures. For example, zinc sulfide doped with manganese produces a yellow color. There are other material combinations for producing other colors, and the primary colors (red, green, and blue) can be produced in a display according to the invention.

Because of the high dot density capability for a display according to the present invention, and also because of the separate and electrically isolated nature of the individual light-emitting structures, a display according to the present invention can be constructed to produce images in color. The inherent ability to vary the intensity of the light by varying the voltage supplied also contributes to color generation, as well as gray scale display.

Figure 7:
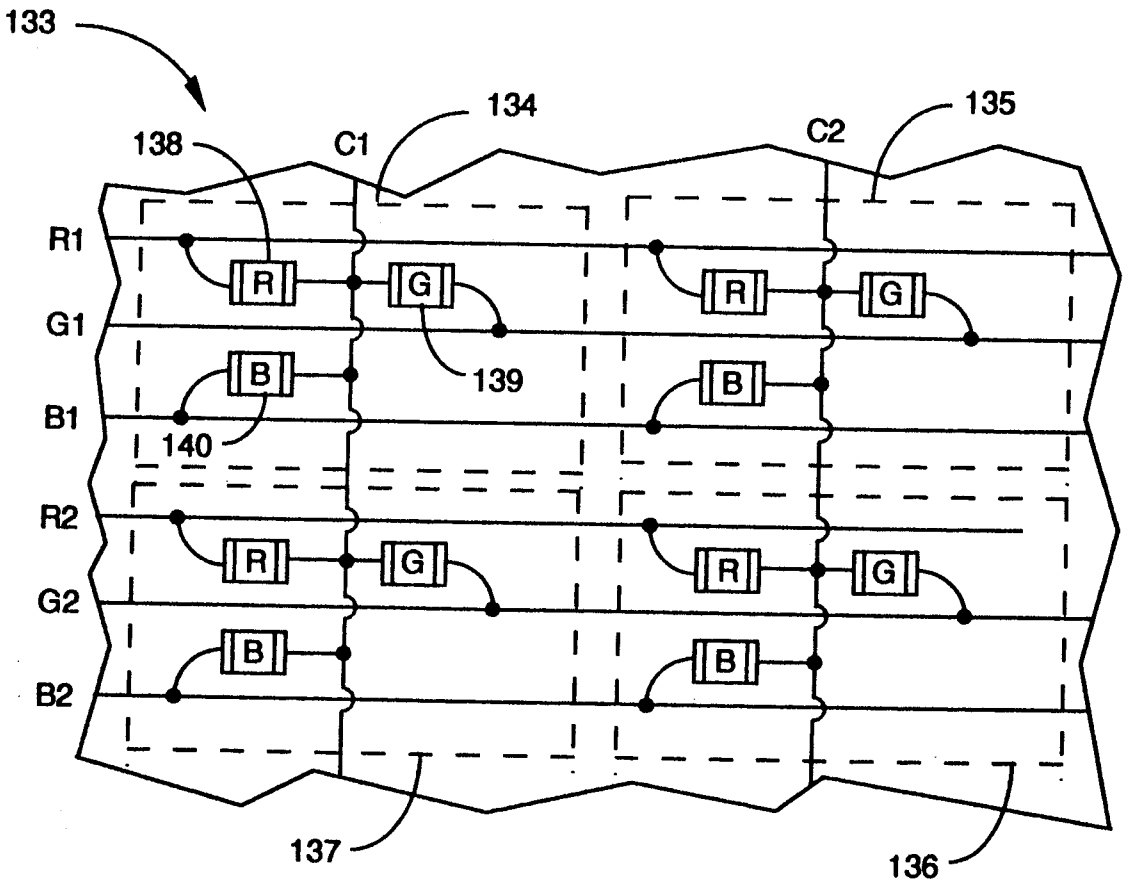
FIG. 7 is a plan view showing an arrangement of cells to provide a display in color according to the present invention.

FIG. 7 shows a plan view of a portion 133 of a display panel according to the invention for producing images in color. Four distinct color groups 134 135, 136, and 137 are shown, and each has three light-emitting cells, one red, one green, and one blue. For example, group 134 has a light-emitting cell 138 for red, a cell 139 for green, and a cell 140 for blue.

Each color group, such as group 134, has three row traces for driving the three color component light-emitting cells in this example, one trace per cell. These are labeled R1, G1, and B1 for group 134 and group 135. Traces R2, G2, and B2 serve groups 137 and 136. The color component cells in each group have a common column trace. For example, trace C1 serves the cells in groups 134 and 137, and trace C2 serves the cells in groups 135 and 136.

As described above, the light-emitting structures of the invention may be driven at a much lower voltage than is necessary for a convention electroluminescent panel display. The reason is that the electrodes are not so far apart in the display of the invention as they are in conventional displays. The conventional panel requires from 150 to 200 volts, while the individual structures of the invention may be driven at about 20 volts. Moreover, varying the voltage varies the intensity of the light output. This phenomenon allows grey scale display for a single-color panel according to the present invention, and allows many colors to be displayed by varying the intensity of the red, green, and blue components of individual color groups.

There are a number of different ways that red, green, and blue light-emitting structures may be arranged to provide a color group, and a number of different routings for providing connective traces.

It will be apparent to one skilled in the art that there are a relatively large number of changes that may be made in the embodiments described without departing from the spirit and scope of the present invention. Many alternatives have already been mentioned above. For example, the elements of the present invention may be produced by thin film techniques and by thick film techniques, as described above, but there are other manufacturing techniques that may be used as well. As another example, displays may be produced according to the invention in a wide variety of sizes. Similarly, there are a wide variety of suitable materials for light-emitting structures and for other elements of the invention. The base material can be silicon, for example, or glass, or even plastic materials. Such changes in detail are within the spirit and scope of the invention.

What is claimed is:

1. An electronic display comprising:

a base means for providing a construction surface;

a plurality of electroluminescent cells arranged in a dot matrix array over said construction surface; and excitation means connected to said electroluminescent cells for selectively electrically exciting said electroluminescent cells;

each of said electroluminescent cells comprising:

a structure of electroluminescent material having a length dimension substantially orthogonal to said construction surface, said length dimension greater than any dimension of said structure parallel to said construction surface;

a first electrode contacting said structure along substantially the length of said structure and connected to said excitation means;

a second electrode contacting said structure along substantially the length of said structure opposite said first electrode and connected to said excitation means, said structure of electroluminescent material being substantially contained between said first and said second electrodes; and insulative means for insulating electrically conductive elements from one another to prevent electrical shorts.

2. An electronic display as in claim 1 wherein said dot matrix array is a rectangular array arranged in rows and columns, and said excitation means comprises:

a plurality of row traces, each row trace adjacent a row of said electroluminescent cells and connected to said first electrode on each electroluminescent cell in said row; and a plurality of column traces, each column trace adjacent a column of said electroluminescent cells and connected to said second electrode on each electroluminescent cell in said column.

3. An electroluminescent cell for an electronic display, comprising:

a structure of electroluminescent material having a length greater than any dimension at right angles to the length, and extending substantially orthogonally to a base surface;

a first electrode of electrically conductive material contacting said structure along substantially the length of the structure; and a second electrode of electrically conductive material contacting said structure along substantially the length of the structure and positioned on the opposite side of said structure from said first electrode, said structure of electroluminescent material being substantially contained between said electrodes.

4. A display as in claim 1 for displaying images in color, wherein said dot matrix array comprises a plurality of color groups, each color group comprising three electroluminescent cells, a first cell made of an electroluminescent material for emitting red light, a second cell made of an electroluminescent material for emitting green light, and a third cell made of an electroluminescent material for emitting blue light.

5. A display as in claim 4 wherein said excitation means comprises variable voltage means for varying the voltage applied to each cell over a range from a minimum to a maximum value.

6. A method for constructing an electroluminescent display comprising the steps of:

forming a plurality of conductive row traces on a base surface, said conductive row traces having a height H above said base surface;

positioning a mask having an array of rows and columns of openings therethrough over and spaced apart from said base surface, the center spacing from row to row for said openings being the centerline spacing between said adjacent rows of conductive row traces on said base surface;

directing a vapor flux of electroluminescent material toward said mask from the side opposite said base surface, a portion of said vapor flux passing through said openings in said mask and solidifying in electroluminescent structures contacting said conductive row traces for substantially the height H of said row traces, said height H being greater than any dimension of one of said electroluminescent structures parallel to said base surface;

applying photoresist material over said rows of conductive row traces and said electroluminescent structures to a depth of substantially the height H of said conductive row traces, leaving the ends of said electroluminescent structures opposite said base surface exposed on a top surface;

exposing said photoresist material through a mask, curing said material except for areas adjacent each of said electroluminescent structures directly opposite the area of contact of said electroluminescent structures with said conductive row traces;

removing uncured photoresist material with solvent so that said photoresist material has holes substantially the height H of said electroluminescent structures on a side of each of said structures opposite the side of contact with one of said conductive row traces; and forming column traces on said top surface by applying conductive material over a silkscreen mask, one of said column traces formed per column of electroluminescent structures, said conductive material being urged into and filling said holes, said column traces arranged at right angles to said row traces and electrically isolated from said row 7. A method of forming an electroluminescent display comprising the steps of:

forming a plurality of structures of electroluminescent material arranged in a dot matrix array on a base surface, each said structure having a height from the base surface greater than any dimension of the electroluminescent structure parallel to the base surface;

forming a first electrode extending along and contacting substantially the height of each said structure of electroluminescent material;

forming a second electrode extending along and contacting substantially the height of each said structure of electroluminescent material opposite said first electrode and not contacting said first electrode, each said structure of electroluminescent material being substantially contained between said first and second electrodes; and connecting said first and second electrodes to an excitation means for providing an excitation voltage selectively across first and second electrodes.

8. A method for forming an electroluminescent display comprising the steps of:

applying a film of electroluminescent material to a base surface;

patterning the film of electroluminescent material and etching away patterned areas to leave separated vertical structures of electroluminescent material extending substantially orthogonal to the base surface, each having a height greater than any dimension parallel to the base surface;

coating the separated vertical structures preferentially from opposite sides with an electrically conductive material;

etching away conductive material to leave conductive electrodes on opposite sides of each of the vertical structures disconnected from other electrodes;

coating the structures and electrodes with a layer of insulative material;

removing the insulative material from the ends of the vertical structures away from the base surface;

opening windows in the insulative material between vertical structures to expose areas of electrodes for connection; and applying electrically conductive traces connecting over the insulative material to the exposed areas of the electrodes for connecting to an electrical excitation means for selectively exciting the electroluminescent material of the vertical structures.

* * * * *